United States Patent [19]

Kuhn

[11] 4,284,014

[45] Aug. 18, 1981

[54] FLOOR SAFE

[76] Inventor: Charles J. Kuhn, 10520 Plainview Ave., Tujunga, Calif. 91042

[21] Appl. No.: 25,376

[22] Filed: Mar. 30, 1979

[51] Int. Cl.[3] ..... E05G 1/02

[52] U.S. Cl. ..... 109/50; 109/64

[58] Field of Search ..... 109/50, 52, 58, 64, 109/74, 77; 49/465; 52/19, 20, 21

[56] References Cited

U.S. PATENT DOCUMENTS

| | | | |
|---|---|---|---|
| 3,747,541 | 7/1973 | Reese | 109/50 |
| 3,911,635 | 10/1975 | Traupe | 52/20 X |
| 4,048,766 | 9/1977 | Dantzer | 52/19 |

*Primary Examiner*—David H. Corbin

*Attorney, Agent, or Firm*—Robert L. Lindgren

[57] ABSTRACT

A safe rigidly and permanently mounted in an opening in a concrete wall or floor. Two interfitting sleeves co-operating in a pre-oriented, rigid relationship with each other and the surface bordering the opening to preclude unauthorized removal. A container element is assembled to one of the sleeves. To retard "sweating" or the accumulation of moisture in the container and to obviate corrosion development, a rigid plastic, such as polyvinyl chloride, is used for container fabrication. A cover is provided which is releasably secured in close fitting relationship to one of the sleeves, capturing a cover plate therebetween in pre-selected orientation adjacent the safe mouth. The co-operation between the cover, the cover plate and the interfitting sleeves maximizes safe security and precludes extraction from or pushing through the opening in the wall or floor.

8 Claims, 5 Drawing Figures

FLOOR SAFE

BACKGROUND OF THE INVENTION

This invention relates to floor or wall mounted safes and more particularly to a safe anchored in a wall or floor with an improved mounting arrangement for securing and retaining the safe in place.

Floor or wall safes may be found in both commercial and domestic establishments for safekeeping of valuables.

Two primary considerations are involved in designing floor and wall safes. First, safes of this type must be securely embedded in the wall or floor in which they may be mounted in a manner precluding unauthorized removal. For example, the use of levers, block and tackles, and other extraction equipment by theives to pull an entire safe from a concrete substructure are well-known criminal techniques. Also, wall safes may be broken using sledge hammers and pry bars to drive the safe through the supporting wall to permit access from the opposite side.

A second consideration in the design of recessed floor or wall safes involves moisture build-up or "sweating" within the container portion during prolonged periods of storage.

As a result of the success that the professional criminals have heretofore experienced in entering recessed floor or wall safes known to the prior art, a clear need has been defined for an improved and quality safe which is difficult, if not impossible, to remove from a retaining concrete wall or floor.

SUMMARY OF THE INVENTION

A safe assembly is received within a pre-formed or drilled opening of a specified diameter formed in a wall or floor formed typically of concrete. A first rigid sleeve carrying a container assembly and having an axially extending taper on its outer surface is inserted within a second expandable sleeve having an outer diameter slightly less than that of the opening in the wall or floor surface, typically of concrete. The diameter of one end of the rigid sleeve is less than the diameter of the expandable sleeve whereas the other end of the sleeve is larger than the diameter of the expandable sleeve, as a result of the taper. When the sleeves are forced together, they engage in a predetermined interfitting relationship such that the taper of the rigid sleeve causes the expandable sleeve to expand radially outwardly to permanently and rigidly secure the safe assembly to the surfaces bordering the opening.

The taper of the rigid sleeve is oriented in the wall or floor opening in a manner such that attempted extraction of the safe will only tend to further radially expand the sleeve into engagement with the expandable sleeve thereby still further resisting extraction. A cover plate overlies the safe receiving opening in the wall or floor and completely overlies and conceals the opening and the interfitting sleeve assembly in a manner precluding either sleeve from being driven inwardly for removal.

A feature of the present invention provides a floor or wall safe that precludes extraction or removal by unauthorized personnel.

Another feature of the present invention provides a floor or wall safe which adheres progressively more rigidly to its supporting surface as one attempts to extract the safe.

The present invention also provides a recessed floor or wall safe or closure which resists being driven inwardly into the wall to preclude unauthorized entry.

Another feature of the present invention provides a floor or wall safe or closure, as discussed above, with a container for storing valuables wherein "sweating" or moisture accumulation is minimized.

Other features of the safe of the present invention will become apparent when considering the following description and the drawing wherein:

DESCRIPTION OF THE PREFERRED EMBODIMENT

Figure 1:
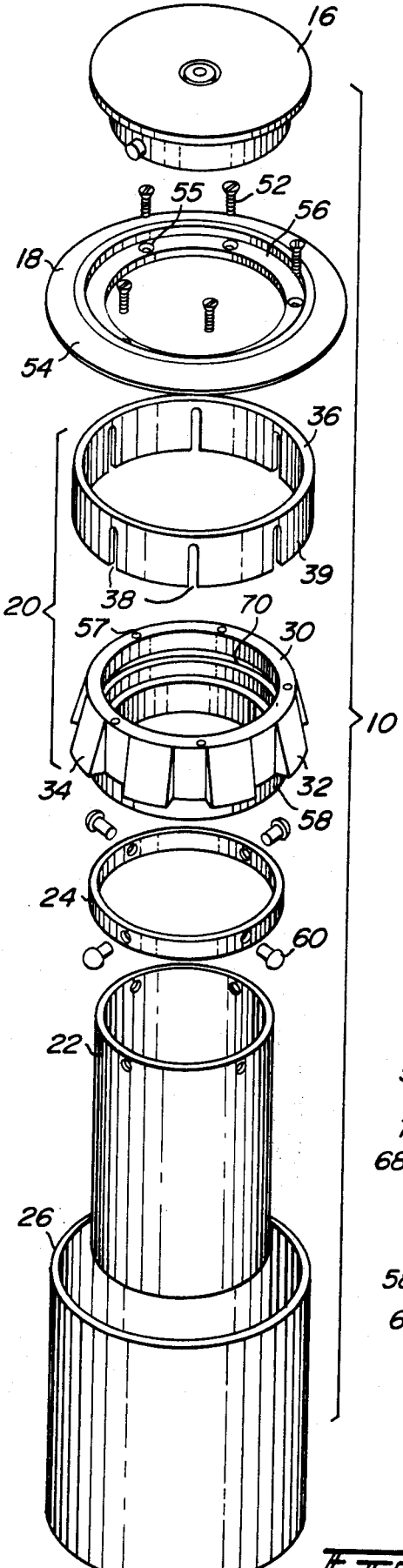
FIG. 1 is an exploded perspective view of an embodiment of the safe in accordance with the present invention.
Figure 2:
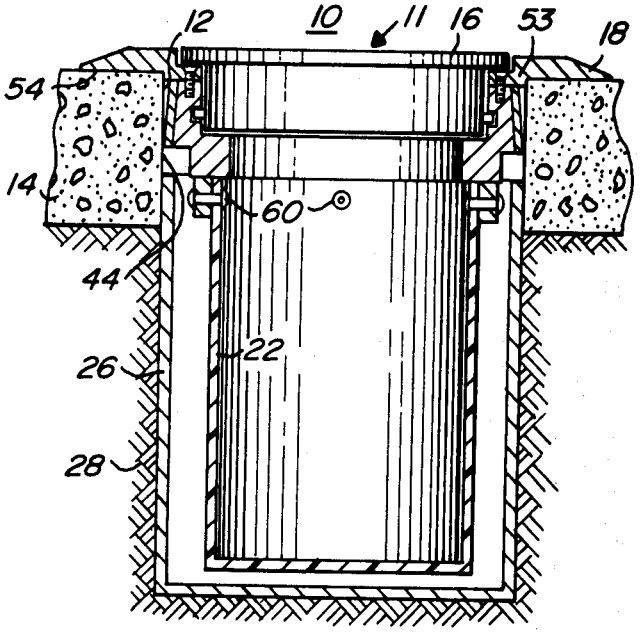
FIG. 2 is a cross-sectional view of the safe mounted in an opening in a concrete floor and having a cover resting upon the opening.

Referring to FIG. 1 and FIG. 2, the safe assembly 10 is shown positioned within a hole, generally designated 11, defined by opening 12 in concrete floor 14. Although the following description is made with respect to a safe mounted in a concrete floor, it should be understood that the safe assembly 10 can be mounted in rigid walls as well. While concrete is a conventional substrate for safe installation other rigid construction materials will serve the necessary support function.

Safe assembly 10 includes a lockable cover 16, a cover plate 18, a pair of interfitting sleeves, generally designated 20, canister or container 22 and retaining ring 24. The safe assembly 10, when in place in some applications, may be surrounded by an encasement element 26 to insure the structural integrity of the assembly in particulate material 28, as illustrated in FIG. 2, or other shiftable environments associated with floor 14.

The interfitting sleeves 20 include a heavy and rigid cast metal annular sleeve 30. As shown in FIG. 1, sleeve 30 is formed with a plurality of projections 32 forming an axially tapered surface 34. Mating sleeve 36 is expandable and may be fabricated from any material capable of being expanded radially and metal is preferred. A plurality of slots 38 defining displaceable tabs 39 extend axially along sleeve 36, as is best seen in FIG. 1, to permit the radial expansion of tabs 39 as will be further explained below.

Figure 3:
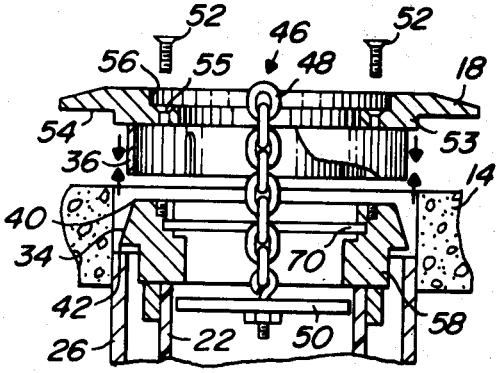
FIG. 3 is a cross-sectional view of the assembly of the cover plate, the rigid and expandable sleeves interfitting with each other in a preselected orientation and alignment to assure the security of the safe, and a tool used to produce the interengagement of the sleeves.

As best viewed in FIG. 3, it is important to note that the upper end 40 of the rigid annular sleeve 30 has a reduced diameter and a larger diameter at opposite end 42, defining a tapered surface 34 therebetween which narrows axially upwardly. The diameter of the expandable sleeve 36 is larger than the diameter at the small end 40 of rigid annular sleeve 30, but is smaller than the diameter at larger end 42. The sleeve assembly 20 is fabricated in a manner such that the wedging interengagement of sleeve elements 30 and 36 will substantially produce the orientation of parts illustrated in FIGS. 2 and 5.

A typical floor installation will involve a drilling operation to produce an opening through the concrete floor having a slightly larger diameter than the largest diameter of sleeve 30 and sufficient to accommodate the safe assembly. As is illustrated in FIG. 2, it is generally necessary to clear rubble or particulate matter from beneath the opening to make room for the complete assembly. In this instance, a cylindrical encasement element 26 is inserted through opening 12 and into the hole provided therefore. Element 26 remains in contact with the floor subsurface 28. Next, annular sleeve 36 is inserted into the opening 12 above sleeve 30 and rests lightly upon rigid sleeve 30 in partially overlapping relation. With these elements loosely in place, a bar 50 affixed to the end of heavy chain 48 is dropped through the mouth portion of the interfitting sleeve assembly 20 as shown in FIG. 3. The bar is arranged in the manner shown in FIG. 3 to engage the heavy bottom wall sleeve flange 58. Any of the commonly available conventional tensioning devices (not shown) capable of loosely overlying the opening 12 in the floor 14 and applying a controlled upward force within an initial lifting of the safe elements from the floor 14 can be used.

The rigid annular sleeve 30 and attached canister 22 is then drawn upwardly into radial expanding engagement with annular sleeve 36. This produces the desired radial expansion of sleeve 36 and progressively more rigid wedging engagement of tabs 39 with the concrete surface 44 defining floor opening 12. The drawing together of sleeves 30 and 36 is continued until the tapered surface 34 of sleeve 30 is in the position illustrated in FIGS. 2 and 5, i.e., the uppermost edges of sleeves 30 and 36 are substantially flush and the outer surface of sleeve 36 has become rigidly and permanently engaged with sidewall 44 of concrete floor 14.

The sleeves 30 and 36 may be drawn together in other manners. For example, heavy screws or bolts screws 52 extending through cover plate 38 and threaded into sleeve 30 can be used to draw sleeve 30 up and into annular sleeve 36 to produce the outward wedging expansion of tabs 39 defined by slots 38 and the force fit of the assembly into rigid engagement with the side walls 44 of the concrete floor 14.

Figure 5:
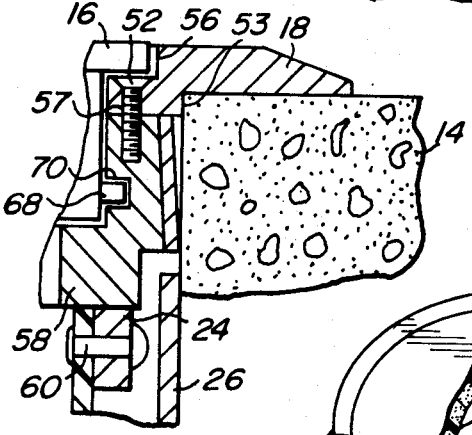
FIG. 5 is a partial but detailed cross-sectional view of the engagement of the safe with a concrete surface.

Once the sleeves 30 and 36 are permanently and rigidly in place with respect to sidewall 44, cover plate 18 may be installed. As is shown in FIGS. 2 and 5, cover plate 18 has been designed to completely overlie floor opening 12 and the upper extremity of sleeve assembly 20 which, when installed, extends to a point slightly below the surface of concrete floor 14. FIGS. 2, 3 and 5 show that the base of cover plate 18 is formed with a generally cylindrical projection 53 which extends down into loose fitting abutting contact with the installed upper extremity of assembly 20. In addition, the cover plate 18 has a lip 54 which extends radially outwardly beyong the perimeter of opening 12.

Cover plate 18 is provided with a recess portion 56. As shown in the drawings, recess portion 56 serves two purposes. First, it serves as a base or platform for fastening the cover plate 18 to rigid sleeve 30. This is accomplished by threading screws 52 through holes 55 provided in the cover plate and into threaded openings 57 provided in the upper extremity of sleeve 30. Generally, this is done to secure the cover plate to the safe assembly as an integral part of it. But, as noted above, heavy screws or bolts can be used as a means for producing the wedge fit of the sleeve assembly 20 in opening 12. Second, recess portion 56 will permit substantially flush mounting of a locking cover 16 which, when applied to the safe, will conceal the exposed heads of the screws 52.

When cover 16 is applied to the safe, cover plate 18 is captured between cover 16 and rigid annular sleeve 30 to which it has been secured by bolts 52. Since, as shown in FIGS. 2 and 5, the lip 54 projects significantly beyond the periphery of opening 12, the safe is now virtually invulnerable to attempts to pound it down and out of engagement with the floor 14 to gain unauthorized access to the contents of container 22. Similarly, efforts to pry cover plate 18 upwardly by driving a tool between concrete floor 14 and the under surface of lip 54, will be defeated by the co-operation between the interfitting sleeves which tends only to enhance the rigid and permanent relationship between them and sidewall 44 in response to the upward application of force.

The canister or container 22 is preferably fabricated from a thermosetting plastic resin, such as a phenol formaldehyde resin. It is attached to lower flange 58 of rigid annular sleeve 30. In order to effectively secure these dissimilar materials, a metal retaining ring may be welded to the under surface of flange 58 as shown in FIGS. 2 and 5. The canister 22 can then be riveted with rivets 60 to the retaining ring 24 to complete the assembly. In some applications, the canister 22 may be secured to the inner periphery of sleeve 30 by adhesive bonding. On the other hand, where a metal canister 22 was used, it could be welded directly to one of the surfaces of the flange 58.

Figure 4:
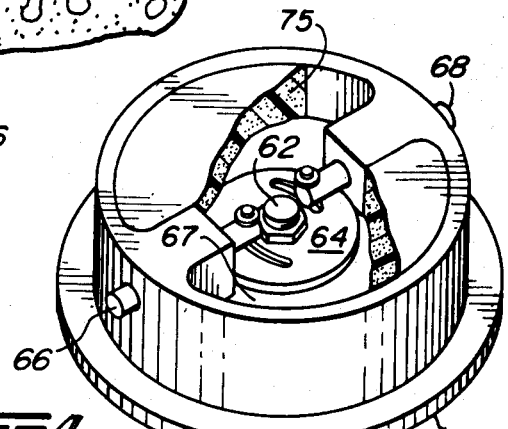
FIG. 4 is a perspective view of the underside of the safe cover.

Referring to FIG. 4, the underside of cover 16 is shown depicting a lock arrangement having a shaft 62 that extends through cover plate 16 to a cam 64 which has two radially extended locking bars 66 and 68 attached thereto. The locking bars 66 and 68 pass through guide holes in the cover 16 and are received within a groove 70 formed in the rigid annular sleeve 30 best seen in FIG. 5. Thus, in the event that one attempted to pry the cover 16 outwardly when the safe 10 is locked, the co-operation between the interfitting sleeves and sidewall 44 would only tend to enhance the engagement thereof. Finally, to inhibit "sweating" or moisture accumulation, the concave portion 67 of the underside of cover 16, is filled with a conventional foamed plastic resin having good insulating characteristics as is shown 75 in FIG. 4.

What is claimed is:

1. A safe assembly adapted to be received within an opening of a specified diameter formed within a rigid wall or floor and immovably retained therein comprising:

a first sleeve having an axially extended tapered portion on its outer surface wherein one outer end of said first sleeve is of a first diameter and the other outer end is of a second and larger diameter, said second diameter being smaller than the receiving floor or wall opening;

a container for storing deposited items within the safe assembly;

means connecting the container to the first sleeve;

a second sleeve having an inner diameter larger than the first diameter of the first sleeve but smaller than the second diameter of the first sleeve and being at least partially deformable; and locking closure means removably secured to the first sleeve for selectively enclosing the storage container of the assembly;

and the first sleeve upon installation in the opening of a rigid wall or floor, engaging the second sleeve and radially expanding at least a portion of the second sleeve into rigid, essentially immovable engagement with the wall or floor surface bordering the opening within which the assembly is adapted to be placed and in a manner such that the application of extracting forces to any portions of the assembly exposed above such an opening will tend to increase the radially expansive forces upon the second sleeve in the opening thereby still further increasing the engagement forces between the first and second sleeves and the opening bordering surface and resisting extraction from the opening.

2. The safe assembly of claim 1 wherein the end of the first sleeve of the first diameter is nearer the wall or floor than the end of the first sleeve of the second diameter.

3. The safe assembly of claim 1 wherein the second sleeve is provided with axially extending and radially expandable tabs to facilitate wedging interengagement of the first and second sleeves.

4. The safe assembly of claim 1 further including an annular cover plate secured to one of the sleeves for covering the wall or floor opening and concealing the safe assembly below it.

5. The safe assembly of claim 1 wherein container is plastic.

6. The safe assembly of claim 1 wherein means are provided on the first sleeve for receiving the locking closure means, and lock means are provided for selectively securing the cover to the first sleeve for authorized entry.

7. The safe assembly of claim 6 wherein the means provided on the first sleeve for receiving the locking closure means include a cover plate overlying the opening and concealing the opening and the safe assembly below it, the cover plate being secured between the locking closure means and the rigidly engaged first and second sleeves.

8. The safe assembly of claim 1 wherein the locking closure means includes an insulated cover.

* * * * *

UNITED STATES PATENT AND TRADEMARK OFFICE

CERTIFICATE OF CORRECTION

PATENT NO. : 4,284,014

DATED : August 18, 1981

INVENTOR(S) : Charles J. Kuhn

It is certified that error appears in the above-identified patent and that said Letters Patent are hereby corrected as shown below:

Col. 3, Line 40, change "38" to --18--.

Signed and Sealed this

*Twenty-fourth* Day of *November 1981*

[SEAL]

*Attest:*

GERALD J. MOSSINGHOFF

*Attesting Officer*

*Commissioner of Patents and Trademarks*